US008016484B1

(12) United States Patent
Cross

(10) Patent No.: US 8,016,484 B1
(45) Date of Patent: Sep. 13, 2011

(54) CONVERTIBLE TOWEL

(76) Inventor: Beth Cross, Tempe, AZ (US)

( * ) Notice: Subject to any disclaimer, the term of this patent is extended or adjusted under 35 U.S.C. 154(b) by 1097 days.

(21) Appl. No.: 11/825,573

(22) Filed: Jul. 5, 2007

(51) Int. Cl.
*B65D 30/00* (2006.01)
*B65D 33/06* (2006.01)
*B65D 30/22* (2006.01)
*B65D 33/28* (2006.01)

(52) U.S. Cl. ..... 383/4; 383/16; 383/40; 383/75; 383/76

(58) Field of Classification Search ..... 383/4, 72, 383/74, 75, 16, 40, 76; 5/417–420
See application file for complete search history.

(56) References Cited

U.S. PATENT DOCUMENTS 1,237,628 A * 8/1917 Ford ..... 5/98.3
2,420,344 A * 5/1947 Alexander ..... 2/69
4,723,327 A * 2/1988 Smith ..... 5/89.1
4,789,247 A 12/1988 Schnoor
4,794,029 A 12/1988 Tennant et al.
4,856,912 A 8/1989 Damus et al.
5,178,310 A * 1/1993 Sowerby ..... 224/153
5,195,828 A 3/1993 Bush-Rodriquez
5,454,643 A 10/1995 Sullivan
5,482,374 A 1/1996 Buhyoff
5,618,110 A 4/1997 Sullivan
5,688,052 A 11/1997 Compton
5,819,343 A 10/1998 Zampirri et al.
5,843,556 A 12/1998 Levas
6,626,491 B1 * 9/2003 Blome et al. ..... 297/229
6,634,041 B2 10/2003 Higashi et al.
2007/0017943 A1 1/2007 Foy et al.
2007/0289061 A1 * 12/2007 Dumoulin ..... 5/417

* cited by examiner

*Primary Examiner* — Jes F Pascua
(74) *Attorney, Agent, or Firm* — Gregory J. Nelson

(57) ABSTRACT

A convertible sport and recreational accessory which is easily convertible for use either as a towel or as a tote bag. The planar towel configuration has an elongate, fabric body with a pair of side panels. Two opposed pairs of drawstrings are encased in seams arranged longitudinally and transversely which, when pulled, will form a pouch. The ends of the body and the side panels may be used as a cover or flap extending into the pouch opening or may be tucked into the pouch. Handles are provided for convenience when the combination towel/tote is in the tote mode or configuration.

8 Claims, 3 Drawing Sheets

CONVERTIBLE TOWEL

FIELD OF THE INVENTION

The present invention relates to sports accessory and more particularly to an improved towel for beach or pool side use which can be easily and quickly converted into a tote bag.

BACKGROUND OF THE INVENTION

An individual engaging in various recreational and sporting activities often will find it necessary to utilize both a towel as well as a tote bag of some type in which to carry various items. For example, an individual going to the beach or pool may normally take a towel used for drying water from the user's body. A towel may also be used as a cover on sand and pool side surfaces or on a chair or chaise lounge for the protection and comfort of the user. In addition, the person may also require various other items for personal comfort and enjoyment such as lotions, food and sunglasses as well as electronic items such as radios, cell phones and devices such as iPODS®.

Accordingly, various combination blankets or towels and bags can be found used as a cover or surface on which the user may sit or recline as well as used as a bag to transport items to and from a location of use can be found in the prior art. Most of these combination beach towels or blankets and tote bags simply consist of an elongate panel having a pocket formed on the panel which can be used for the containment of items. In some cases, a closure or drawstring is provided in the pocket.

Other articles which can serve both as a towel or a tote bag may be constructed from different types of fabric materials and generally are circular or somewhat circular and have one or more circumferentially positioned drawstrings to which tension can be applied to conversion of the towel into a bag-like structure.

Notwithstanding prior art combination devices, as described above, there nevertheless exists the need for an improved personal accessory which has the overall configuration of a towel on which user can sit or recline and which also can be used as a cover in connection with a chair or chaise lounge. There further exists the need for such a device which can be easily and quickly converted to a tote bag of convenient size for reception and carrying various personal and accessory items.

BRIEF SUMMARY OF THE INVENTION

The present invention provides a towel which may be quickly and conveniently converted into a tote bag. The term "towel" is used in a broad sense to describe an item of fabric or similar material, which can be used for drying a person's body or which can be used as a blanket or cover which may be placed on the ground or on an item such as a chair or chaise lounge for comfort and protection.

The convertible towel and tote or carryall bag in the towel configuration has an elongate main body section which is generally rectangular and is made from a suitable fabric material. Preferably the material may be cotton, linen, polyester or other material and has one surface provided with a suitable design or decorative images. The opposite surface is covered or partially covered with a moisture-absorbent material such as a terry cloth. At an intermediate location along the body, a pair of fabric panels extend outwardly so that the towel has a cross-like configuration. Drawstrings are encased in seams extending both transversely and longitudinally in the body at an intermediate location corresponding to that of the panels. When the drawstrings are pulled, the central area of the body is drawn together to form a pouch. Locking slides are provided on the drawstrings so that the drawstrings may be secured to maintain the configuration of the pouch. The side panels and the upper and lower ends of the main body may then be folded inwardly to provide a cover for the pouch interior. Carry straps are provided and are sewn or otherwise secured to the body so that when the article is assembled in the tote configuration for carrying articles, the user can easily lift and transport the combination towel and tote by grasping the handles.

BRIEF DESCRIPTION OF THE DRAWINGS

The above and other advantages and objects of the present invention will become more apparent from the following description, claims and drawings in which:

DETAILED DESCRIPTION OF THE DRAWINGS

Figure 1:
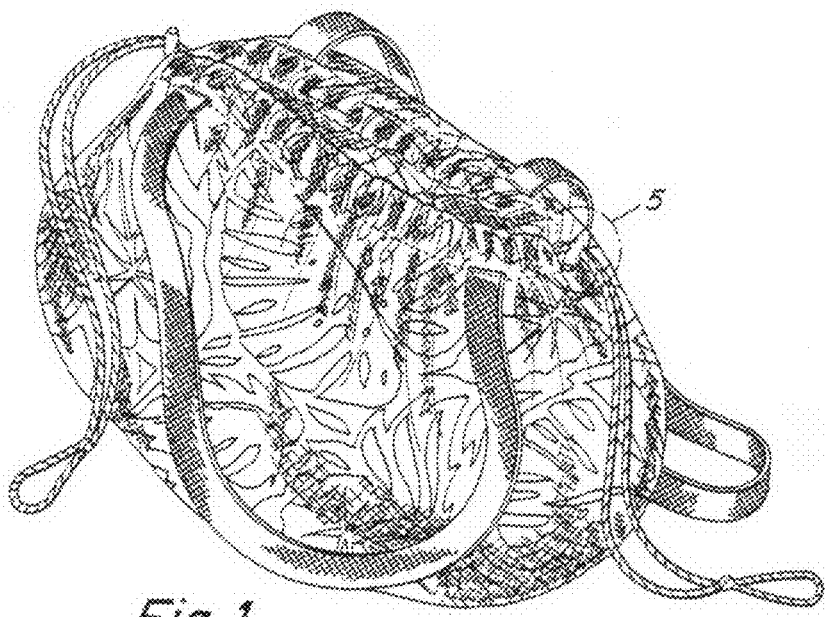
FIG. 1 is a perspective view showing the convertible towel formed into a tote bag with the drawstrings secured.
Figure 5:
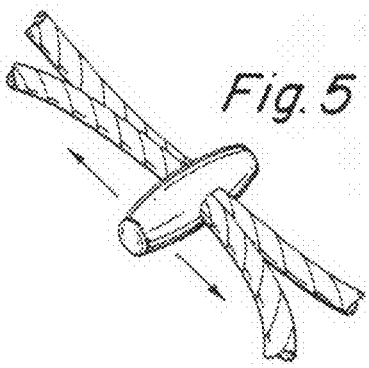
FIG. 5 is a detail view of the slide locks used to secure the drawstrings, as indicated in FIG. 3.

Turning to the drawings, the convertible towel is generally designated by the numeral 10 and has a generally elongate main body section 12 which has upper edge 14, lower edge 16 and opposite, parallel sides 18 and 20. The main body section 12 is shown as being generally rectangular and may be variously dimensioned and is preferably about 24" to 36" wide and 72" to 80" in length to fully accommodate the body length of a reclining individual.

Figure 3:
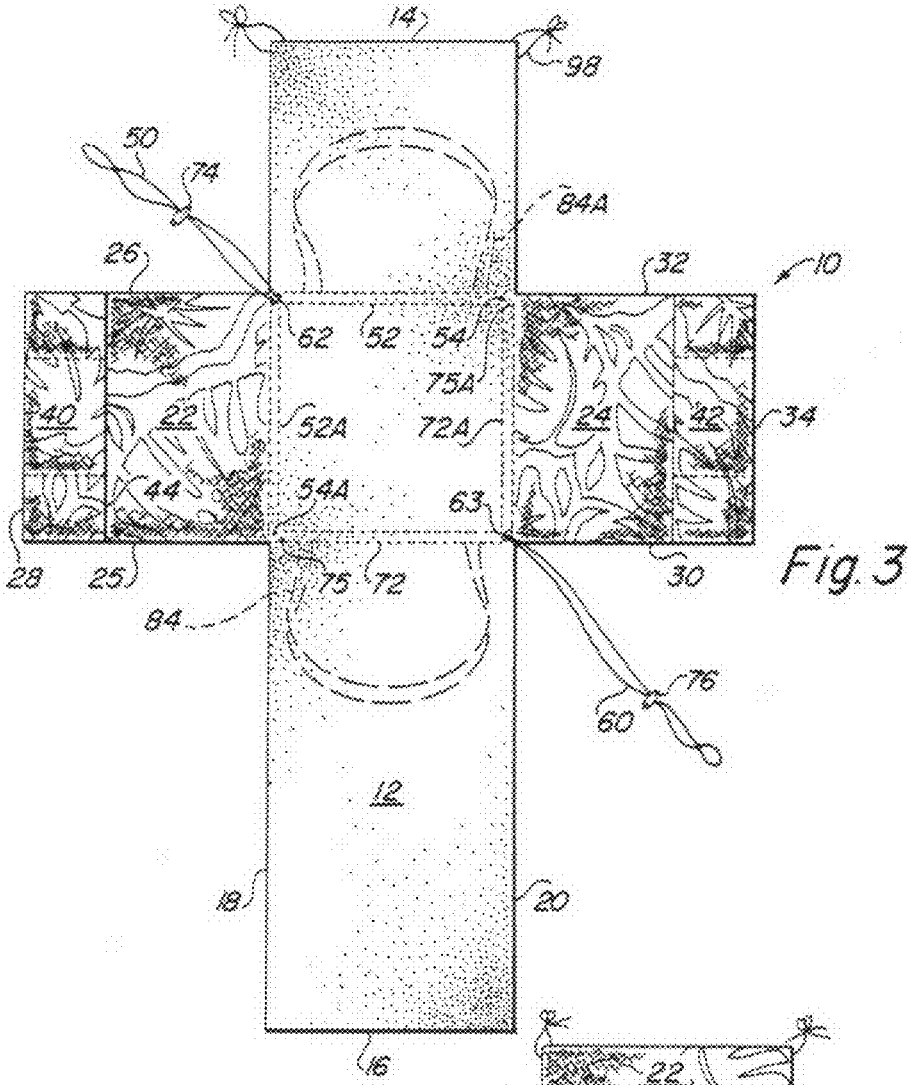
FIG. 3 is a plan view of the top side of the convertible towel of the present invention.
Figure 4:
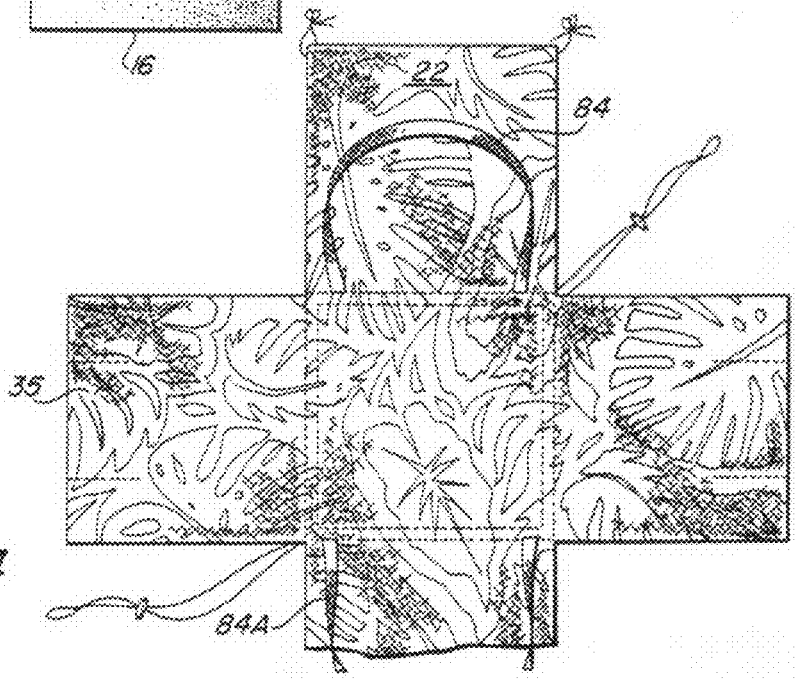
FIG. 4 is a partial plan view of the upper end of the bottom side of the convertible towel of the present invention.

At an intermediate location, opposed side panels 22 and 24 extend from the sides of the main body 12. The side panels are preferably generally rectangular, but may be other shapes such as semi-circular. Panel 22 has opposed edges 25, 26 and end 28. Similarly, panel 24 has opposed edges 30, 32 and end 34. Preferably, the side panels 22, 24 and the body 12 are of a suitable fabric material such as a cotton, canvas, polyester or other material which is sturdy and can be variously colored or imprinted with a suitable design. As best seen in FIGS. 3 and 4, a representative fabric print 35 is shown as a floral design.

Figure 7:
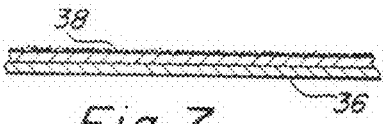
FIG. 7 is a representative cross-sectional view through the convertible towel of the present invention showing the several layers or plies of fabric material used in the construction of the towel.

The towel has a top and bottom surface. As used herein the term "bottom" refers to the side of the convertible towel which would normally be disposed on a surface such as on a beach, pool deck or on a lounge chair. The upper or top surface, as seen in FIG. 3, would be the surface upwardly disposed and against which the user would normally sit or recline. For comfort, the upper surface is preferably partially a soft, moisture-absorbent material such as a terry cloth. The several layers or plies are best seen in FIG. 7 in which the bottom surface is designated by the numeral 36 and the top surface designated by numeral 38.

The convertible towel may be fabricated by conventional sewing techniques. The side panels 22 and 24 may be further provided with pockets 40 and 42 disposed at the outer ends of the panels. The pockets may be formed by applying sections of fabric material overlying the panels 22 and 24 applying appropriate stitching along the edges of the overlying material and at intermediate locations to form a plurality of pockets as shown. These pockets are accessible at openings extending along edge 44 of the overlying pockets 40, 42.

Figure 6:
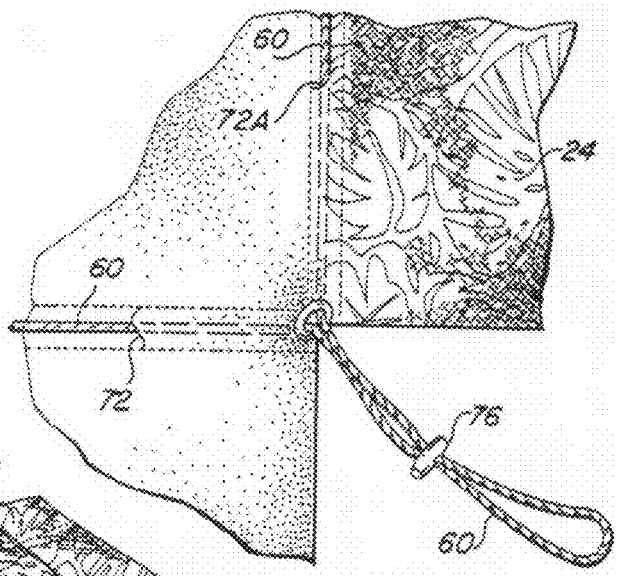
FIG. 6 is a partial detail view of a section of the top side of the convertible towel showing two adjacent drawstring seams and the projecting drawstring.

The conversion of the convertible towel from a planar towel to a tote bag is accomplished by means of opposed pairs of drawstrings which, when tightened, form a pouch in the body 12. A first drawstring 50 extends within a casing 52 transversely of the main body of the convertible towel. Casing 52 is aligned with the edges 26 and 32 of the side panels. One end of drawstring 50 is affixed within casing 52 at 54. The drawstring 50 extends through an eyelet 62 outwardly of the casing and is looped with the opposite end extending in longitudinal casing 52A with the opposite end secured at 54A. The exposed sections of the drawstring 50 are threaded through slide connector 74. A second drawstring 60 extends in casing 72 which is parallel to casing 52 of one end of the drawstring 60 and is affixed at the end of the casing 72 at location 75A and extends outwardly through an eyelet. Drawstring 60 is looped and has an end section in casing 72A which is secured at 75A at the end of casing 72A. The outer section of drawstring 60 is threaded through connection 76, as best seen in FIGS. 3 and 6. Thus, each drawstring extends in a casing both longitudinally and transversely of the body 12.

As best seen in FIG. 4, a pair of straps 84, 84A are provided so the user may conveniently grasp the convertible towel when in the converted tote position. Strap 84 has opposite ends secured to the main body 12 adjacent the opposite sides of side panel 22. Strap 84A is similarly secured extending from the main body at locations adjacent the opposite sides of the side panel 24. In use, the convertible towel may be used as a cover or blanket on which a user may sit or lie, such as at pool side, on a beach or other location. The convertible towel is preferably used with the soft, moisture-absorbing surface 38 disposed upwardly and the side panels extending outwardly. This provides a comfortable, ample surface for the user and the user may lie with his or her arms extending outwardly protected by the side panels. Also, any personal or convenience items stored in the pockets 40, 42 of the side panels are conveniently located for access.

Figure 2:
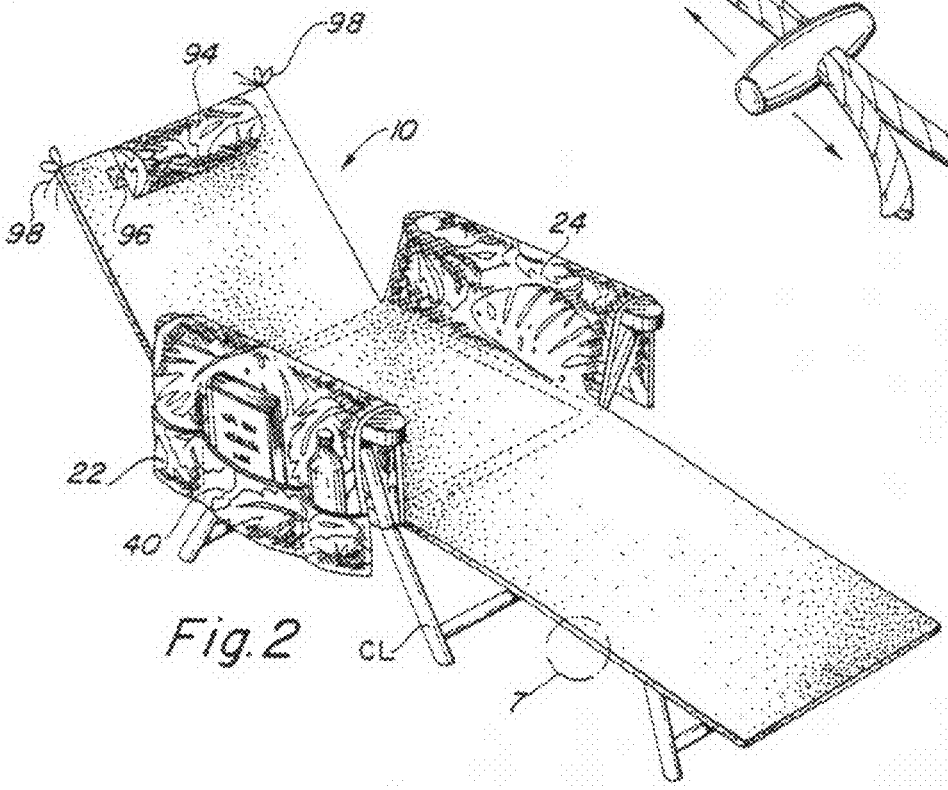
FIG. 2 is a perspective view showing the convertible towel used as a cover on a lounge- or chaise-style chair.

As shown in FIG. 2, the convertible towel can be used in conjunction with a chair such as a chaise lounge CL. The configuration of the convertible towel conveniently accommodates this use and the side panels 22, 24 may be extended over the arms of such a chair or chaise. The side pockets 40, 42 are positioned for providing convenient access to various items such as reading materials or beverages, as shown in FIG. 2. The side panels 22 and 24 will extend over the arms of a chaise or lounge chair providing further protection and comfort for the user's body, as well as providing a sanitary barrier in situations where such chairs are used by various individuals.

Also, as shown in FIG. 2, an optional pillow 94 may be provided which is secured to the upper edge 14 of the main body 12. The pillow may be detachably secured by use of hook and loop fastener material 96 such as that commonly sold under the trademark Velcro®. Ties 98 may be provided at the upper end 14 of the body 12 to affix the towel to the chair base to prevent the towel from sliding.

Figure 8A:
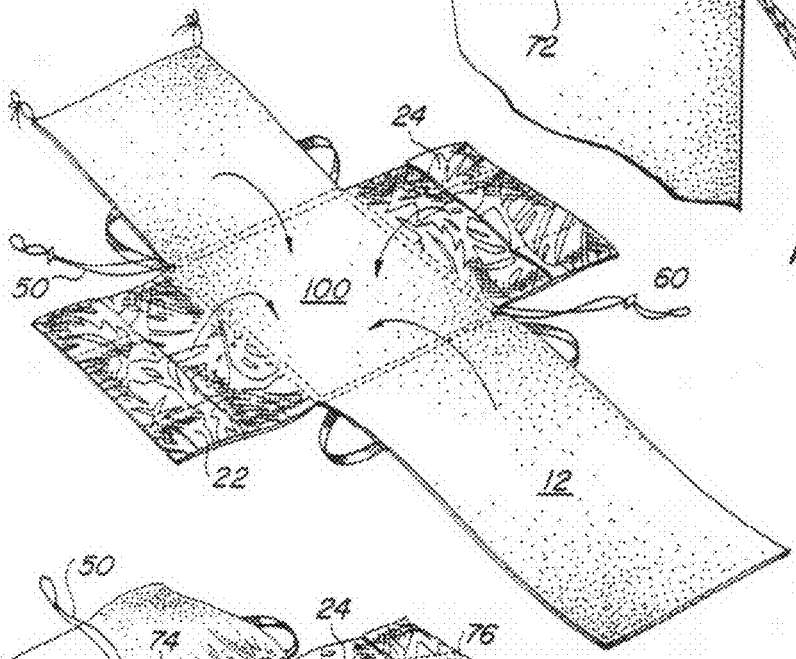
FIGS. 8A through 8C illustrate the steps in converting the convertible towel from a generally flat condition in which it is used as a towel or cover to a condition or mode in which it has been converted into a carry bag or tote.
Figure 8B:
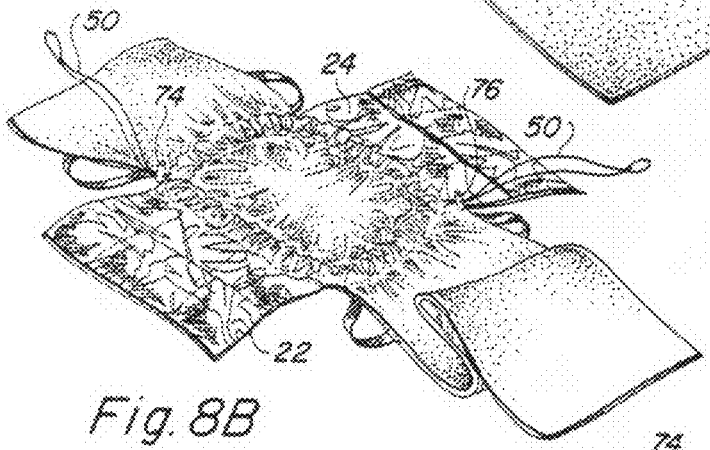
Figure 8C:
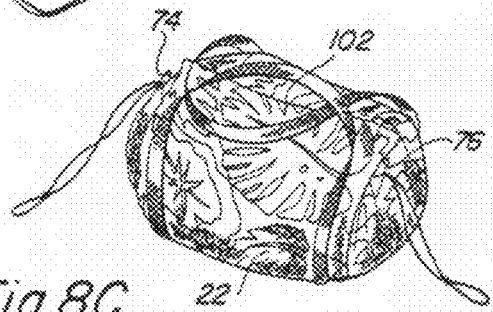

When the user wishes to convert the convertible towel into a tote, the user will exert an outward pulling force on the outer sections of the drawstrings 50 and 60. Referring to FIG. 8A, it will be seen that when outward pulling forces are applied, the drawstrings will cause the central area 100 boundried by the drawstrings to be formed into a pouch 102. The pouch 102 will accommodate various items. The upper and lower end of the main body section 12, as well as the side panels 22 and 24, can be folded inwardly into the pouch or one or more of these panels may be used as a flap or covering extending across the opening into the pouch, as seen in FIG. 8A. Once the convertible towel is formed into a pouch, it can be secured in this position by moving the slides 74, 76 along the drawstrings to the cinched position shown in FIG. 1. In this position, the slides will prevent the pouch from unintentionally opening and will retain the convertible towel in the converted position in which it serves as a tote or bag.

It will be apparent that the drawstrings 50 and 60 which are each shown as a single length of cord having end sections can be separated into separate drawstrings having one end in a casing and an exterior end outward of the body to which a pulling force is applied.

It will be obvious to those skilled in the art to make various changes, alterations and modifications to the invention described herein. To the extent such changes, alterations and modifications do not depart from the spirit and scope of the appended claims, they are intended to be encompassed therein.

I claim:

1. A sport and recreational accessory convertible from a cover for a chaise lounge having arms to a tote bag for personal items comprising:

(a) a generally elongate rectangular main body of fabric, said body having opposite longitudinal first and second sides and opposite first and second ends and being approximately 72" to 80" in length;

(b) a first drawstring encased in said body and extending transversely of said body at a first location, said first drawstring projecting from a first opening in said body at said first side;

(c) a second drawstring encased in said body and extending longitudinally along a first side of said body at a second location adjacent from said first drawstring, said second drawstring projecting from said first opening;

(d) a third drawstring encased in said body extending transversely of said body and spaced from said first drawstring and projecting from a second opening in said body at said second side;

(e) a fourth drawstring encased in said body extending longitudinally along the second side of said body and projecting from said second opening, said drawstrings defining a generally rectangular intermediate area in said body, whereby manual application of tension to said drawstrings will cause the intermediate area to gather, forming a tote enclosed on all sides; and (f) transverse side panels extending oppositely from the sides of the body in said intermediate area.

2. The sport and recreational accessory of claim 1 wherein said first and second drawstrings and said second and third drawstrings are integral.

3. The sport and recreational accessory of claim 1 further including straps having opposite ends attached to said body adjacent said side panels.

4. The sport and recreational accessory of claim 1 wherein said body is a durable fabric having a moisture absorbing surface.

5. The sport and recreational accessory of claim 1 wherein said drawstrings are provided with slidable locking members.

6. The sport and recreational accessory of claim 1 wherein at least one side panel is provided with a pocket.

7. The sport and recreational accessory of claim 1 wherein said water resistant fabric is imprinted with a design.

8. The sport and recreational accessory of claim 1 further including a cushion at one end of the body.

* * * * *